US008558859B2

(12) United States Patent
Jerman et al.

(10) Patent No.: US 8,558,859 B2
(45) Date of Patent: Oct. 15, 2013

(54) LASER PRINTER WITH MULTIPLE LASER-BEAM SOURCES

(75) Inventors: John H. Jerman, Palo Alto, CA (US); Sergei Govorkov, Los Altos, CA (US)

(73) Assignee: Coherent, Inc., Santa Clara, CA (US)

( * ) Notice: Subject to any disclaimer, the term of this patent is extended or adjusted under 35 U.S.C. 154(b) by 83 days.

(21) Appl. No.: 13/090,971

(22) Filed: Apr. 20, 2011

(65) Prior Publication Data

US 2012/0268548 A1 Oct. 25, 2012

(51) Int. Cl.
*B41J 15/14* (2006.01)
*B41J 27/00* (2006.01)

(52) U.S. Cl.
USPC ..... 347/241; 347/256

(58) Field of Classification Search
USPC ..... 347/224, 225, 229, 233, 234, 241, 242, 347/248, 256, 257
See application file for complete search history.

(56) References Cited

U.S. PATENT DOCUMENTS

| | | | | |
|---|---|---|---|---|
| 4,030,122 | A | 6/1977 | Chemelli et al. | |
| 4,233,612 | A | 11/1980 | Hirayama et al. | |
| 4,564,736 | A | 1/1986 | Jones et al. | |
| 4,602,858 | A | 7/1986 | Serge | |
| 4,900,130 | A * | 2/1990 | Haas | 359/198.1 |
| 4,946,234 | A | 8/1990 | Sasada et al. | |
| 5,257,038 | A | 10/1993 | Ferschl et al. | |
| 5,262,613 | A | 11/1993 | Norris et al. | |
| 5,303,081 | A | 4/1994 | Totsuka et al. | |
| 5,385,092 | A * | 1/1995 | Lewis et al. | 101/467 |
| 5,495,279 | A | 2/1996 | Sandstrom | |
| 5,821,977 | A | 10/1998 | Nishimura | |
| 5,855,969 | A | 1/1999 | Robertson | |
| 6,075,759 | A | 6/2000 | Yanagawa et al. | |
| 6,097,742 | A | 8/2000 | Caprara et al. | |
| 6,335,824 | B1 | 1/2002 | Overbeck | |
| 6,362,451 | B1 | 3/2002 | Karni et al. | |
| 6,404,313 | B2 | 6/2002 | Asada | |
| 6,433,809 | B1 * | 8/2002 | Kodama | 347/233 |
| 6,489,985 | B1 | 12/2002 | Brodsky et al. | |
| 6,676,878 | B2 | 1/2004 | O'Brien et al. | |
| 6,818,591 | B2 | 11/2004 | Arai et al. | |
| 6,843,568 | B2 | 1/2005 | Schenk et al. | |
| 6,882,462 | B2 | 4/2005 | Helsel et al. | |
| 7,407,105 | B2 | 8/2008 | Massieu | |
| 7,436,423 | B2 | 10/2008 | Mizuyama et al. | |
| 7,573,625 | B2 | 8/2009 | Cannon et al. | |
| 7,952,603 | B2 | 5/2011 | Govorkov et al. | |
| 2004/0094728 | A1 | 5/2004 | Herzog et al. | |

(Continued)

OTHER PUBLICATIONS

Non Final Office Action received for U.S. Appl. No. 13/050,722, mailed on Aug. 5, 2011, 13 pages.

(Continued)

*Primary Examiner* — Hai C Pham
(74) *Attorney, Agent, or Firm* — Morrison & Foerster LLP

(57) ABSTRACT

A laser printer arranged to print a pixellated image on laser sensitive tape includes a carriage on which are arranged two laser-beam sources delivering separately modulated laser-beams and optics for focusing the beams on the tape. The tape is mounted on a tape drive which drives the tape incrementally in one direction. The carriage is translated over the tape in a direction perpendicular to the tape-drive direction, while the modulated beams are focused. Two rows of the pixellated image are drawn across the tape in this manner. The tape is then incremented and a further two rows are drawn.

13 Claims, 6 Drawing Sheets

(56) References Cited

U.S. PATENT DOCUMENTS

| | | | | |
|---|---|---|---|---|
| 2005/0269298 | A1 | 12/2005 | Hotta et al. | |
| 2006/0215138 | A1 | 9/2006 | Liu | |
| 2007/0008401 | A1 | 1/2007 | Cannon et al. | |
| 2007/0268950 | A1 | 11/2007 | Spinelli et al. | |
| 2010/0053299 | A1 | 3/2010 | Govorkov et al. | |
| 2010/0078857 | A1* | 4/2010 | Govorkov et al. | 264/400 |
| 2010/0079572 | A1 | 4/2010 | Govorkov et al. | |
| 2010/0079834 | A1 | 4/2010 | Jerman | |

OTHER PUBLICATIONS

Non Final Office Action received for U.S. Appl. No. 12/539,985, mailed on Dec. 15, 2011, 17 pages.

Govorkov et al., "Unpublished U.S Appl. No. 12/202,604, filed Sep. 2, 2008, titled " Wide Field Diode-Laser Marker With Swinging Projection-Optics, 17 pages.

Non Final Office Action received for U.S Appl. No. 12/240,126, mailed on Jun. 15, 2010, 17 pages.

Non Final Office Action received for U.S Appl. No. 12/240,146 , mailed on Oct. 5, 2010, 8 pages.

Final Office Action received for U.S Appl. No. 12/240,126, mailed on Nov. 22, 2010, 13 pages.

Non Final Office Action received for U.S Appl. No. 12/233,026, mailed on Dec. 8, 2010, 16 pages.

Notice of Allowance received for U.S Appl. No. 12/240,126, mailed on Feb. 18, 2011, 9 pages.

Notice of Allowance received for U.S Appl. No. 12/240,146, mailed on Feb. 23, 2011, 5 pages.

Notice of Allowance received for U.S Appl. No. 12/233,026, mailed on Apr. 15, 2011, 14 pages.

* cited by examiner

LASER PRINTER WITH MULTIPLE LASER-BEAM SOURCES

TECHNICAL FIELD OF THE INVENTION

The present invention relates in general to printers using a focused laser-radiation beam to mark or print on a laser-radiation sensitive medium. The invention relates in particular to such printers configured to form an image in an incrementally movable laser-radiation sensitive medium by translating a modulated laser-beam repeatedly over the medium in a direction transverse to the motion direction of the medium.

DISCUSSION OF BACKGROUND ART

Since diode-lasers were developed to deliver enough power to mark a laser-radiation sensitive medium with a short pulse delivered from a diode-laser, several printing or marking arrangements using diode-laser sources have been conceived, and some have been commercialized. In all such printers or markers, it is necessary to scan a laser-beam, modulated according to image information, over the laser-radiation sensitive medium to form an image on the medium. Various scanning methods have been proposed or implemented. These range from scanning using a two-axis galvanometer arrangement to scan over a stationary medium, to translating a laser-beam repeatedly over a moving medium.

In certain moving-medium implementations, the medium is moved linearly by a tape transport or drum with the laser-beam translating in the direction of motion. The medium is usually moved incrementally (row-by-row). In other moving-medium limitations the medium is rotated while supported on a disc with the laser-beam translating radially over the disc-supported medium.

One measure of performance of a laser printer or marker, image quality being equal, is the speed with which an image is produced. Related to this is the speed with which a laser-beam can scanned across a medium. In a galvanometer scanning device, scan speed is limited primarily by available power in the laser-beam, as galvanometer scanning itself can be extremely rapid. In other schemes where the laser-beam is scanned mechanically, using a translating platform on which a laser and focusing optics are mounted, or using a translating platform on which optics are mounted with remote delivery of the laser-beam to the optics, the image production speed can be limited by the speed at which the platform can be translated.

U.S. Pre-Grant Publication No. 20100079572 describes a laser printing arrangement wherein a laser-sensitive medium in tape form is moved incrementally in the length direction of the tape, and a scanner head is translated perpendicular to the length direction of the tape. The scanner head includes a scanner which scans a laser-beam in one-dimension (the length or motion direction of the tape) only. The scanning allows a plurality N of image rows, for example about ten, to be printed in one translation of the scanner head. This cuts down on the scan-head translation-speed needed by a factor of N. This also permits the tape to be incremented one every N rows compared with once every row in a non-scanning arrangement.

While the arrangement of the '572 publication provides a solution to the above discussed translation-speed problem, it still involves the use of a scanner. Scanners, even one-dimensional scanners, can be relatively expensive items, particularly if they are to be made reliable enough to withstand mechanical forces encountered as a result of translation in translating scanner-head. Such forces can be relatively high on direction changes of the scanner-head. There is a need for a laser printer arrangement for printing using a translating print-head that can achieve higher printing speeds without the need for a correspondingly higher translation speed, and without the need for a scanner device of any kind.

SUMMARY OF THE INVENTION

The present invention is directed to apparatus for drawing an image on laser-radiation-sensitive tape, the image comprising a plurality of rows of image-elements. In one aspect, apparatus in accordance with the present invention comprises a tape-drive arranged to drive the tape incrementally in a first direction and a carriage translatable over the tape in a second direction transverse to the first direction. A plurality of laser-beam sources is mounted on the carriage. The laser-beam sources are spaced apart by a predetermined first distance in the first direction, and each thereof is arranged to deliver a laser-beam modulated in accordance with a row of image-elements of the image to be drawn. An optical arrangement is mounted on the carriage for focusing the laser-beams on the tape, such that each focused beam draws an image-element during an "on" period thereof. The beam-foci are spaced apart in the second direction by a second predetermined distance corresponding to the first predetermined distance. When the carriage is translated over the tape with the modulated laser-beams focused thereon, a plurality of second-direction spaced-apart rows of the image-elements is drawn with each translation of the carriage over the tape, the plurality of rows corresponding to the plurality of laser-beam sources.

In one embodiment of the invention the laser-beam-sources in the plurality thereof are distal ends of a corresponding plurality of optical fibers the distal ends of optical fibers the proximal ends of which receive modulated radiation from a corresponding plurality of individually modulated lasers. In another embodiment of the invention the plurality of laser-beam sources is an array of individually modulated diode-laser emitters.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below, serve to explain principles of the present invention.

DETAILED DESCRIPTION OF THE INVENTION

Figure 1A:
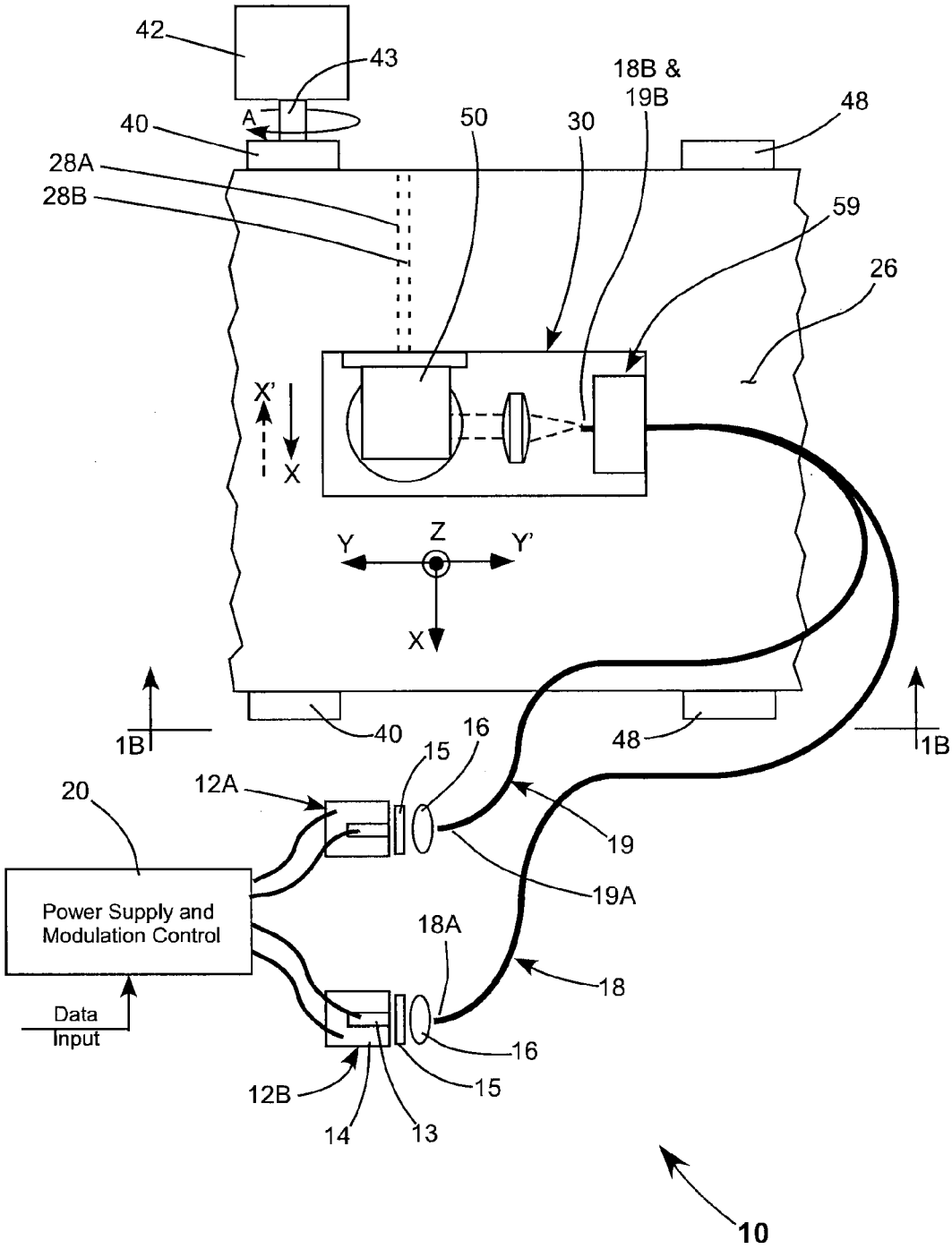
FIG. 1A is a plan view from above schematically illustrating one preferred embodiment of laser marking apparatus in accordance with the present invention including a laser-radiation sensitive tape longitudinally movable, a carriage translatable in a lateral direction across the tape, an alignment block mounted on the carriage and holding distal ends of first and second optical fibers, first and second diode-lasers and optics arranged to focus modulated laser radiation into respectively the first and second optical fibers, and optics for focusing beams from the distal ends of the optical fibers on the tape, with distal ends of the fibers being positioned such that the focused modulated radiation draws two rows of image pixels on the tape on each translation of the carriage across the tape.
Figure 1B:
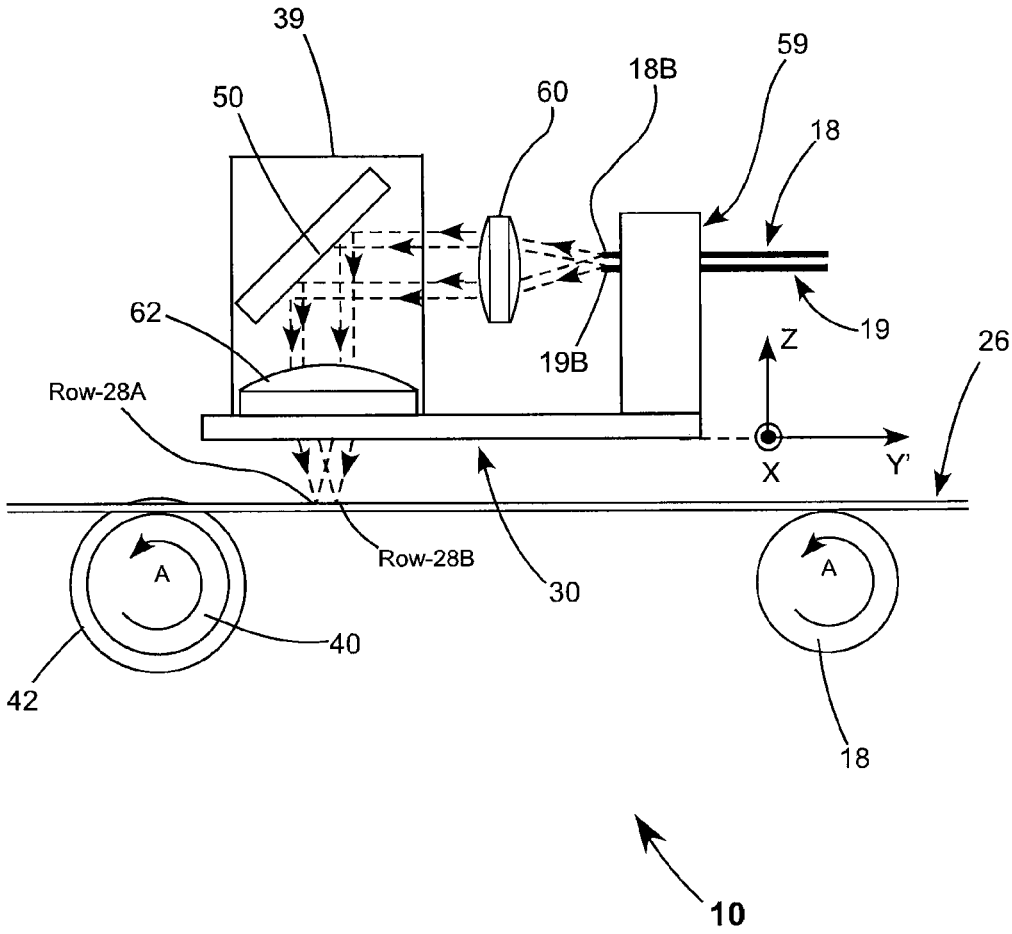
FIG. 1B is a side elevation view schematically illustrating further details of the apparatus of FIG. 1A.

Referring now to the drawings, wherein like components are designated by like reference numerals, FIG. 1A and FIG. 1B schematically illustrate a preferred embodiment 10 of laser marker apparatus in accordance with the present invention. Apparatus 10 includes a plurality (here two) of diode-lasers 12A and 12B. Each diode-laser includes an edge-emitting semiconductor hetero structure (emitter) 13 on a metalized, insulating sub-mount 14. A heat-sink for cooling the sub-mount is preferably provided, but is not shown in the drawings for simplicity of illustration.

Each emitter 13 emits a beam of radiation diverging in the fast axis of the emitter at an angle of about 30° measured across the FWHM intensity points of the beam. Divergence in the slow-axis (perpendicular to the fast axis) is about 10° (see FIG. 1). These divergences should not be construed as limiting the present invention. The beam of radiation from the emitter is intercepted by a cylindrical lens 15 which collimates the beam in the fast axis. The fast axis-collimated beam is focused by a lens 16 into an optical fiber. Radiation from diode-lasers 12A and 12B is focused into proximal ends 18A and 19A of optical fibers 18 and 19 respectively. Alternatively, lens 16 may be omitted and the proximal end of the fiber can be butt-coupled against cylindrical lens 15.

A controller 20 includes modulatable current supplies for the diode-lasers. The current supplies are individually modulated corresponding to image data input from an external source such as a personal computer (PC), and a selected printing algorithm. Such algorithms are discussed further hereinbelow.

Laser-radiation sensitive (laser-sensitive) tape 26 to be marked is driven by a roller 40, which in turn is driven by a stepper motor 42 via a drive shaft 43 revolving in a direction indicated by arrow A. Tape 26 spans roller 40 and idler roller 48. Preferably, additional idler-rollers (not shown) are provided for keeping the tape in contact with rollers 40 and 48. A carriage 30 is translatable back and forth in a direction (X) transverse to the direction (Y) in which the tape is driven by roller 40. Translatable printer carriage mechanisms are well known in the art and can be readily design by one skilled in the mechanical arts. Accordingly, such a translation mechanism is not depicted in FIGS. 1A and 1B for simplicity of illustration.

Mounted on carriage 30 is a fiber-alignment block 59. Optical fibers 18 and 19 transporting radiation from the diode-laser sources are held in block 59 with distal ends 18B and 19B thereof one above another, but not necessarily aligned with each other, in a Z-direction perpendicular to the X- and Y-directions. Diverging beams of radiation (one from each optical fiber) are collimated by a lens 60. The collimated beams are folded at 90° by a mirror 50 and then focused onto tape 26 by another lens 62. In effect, the ends of the fibers are imaged by lenses onto the tape. The beams are modulated corresponding to image data as discussed above and draw (print or mark) two rows 28A and 28B of elements (pixels) of an image being printed, on each pass of carriage 30 over the tape.

The next-two rows can be drawn by incrementally moving the tape by two row-spacings, then translating carriage 30 again. Translation of the carriage can be in a direction X', opposite to that direction (X) in which the previous two rows were drawn. Alternatively, the carriage can be returned across the tape and the carriage translated in the same (X) direction. A printing algorithm would need to be adjusted to reflect the choice of printing directions. It will be evident that whatever the algorithm selected, an image being printed will build up in a direction Y' opposite to the direction Y in which the tape is advanced.

Figure 1C:
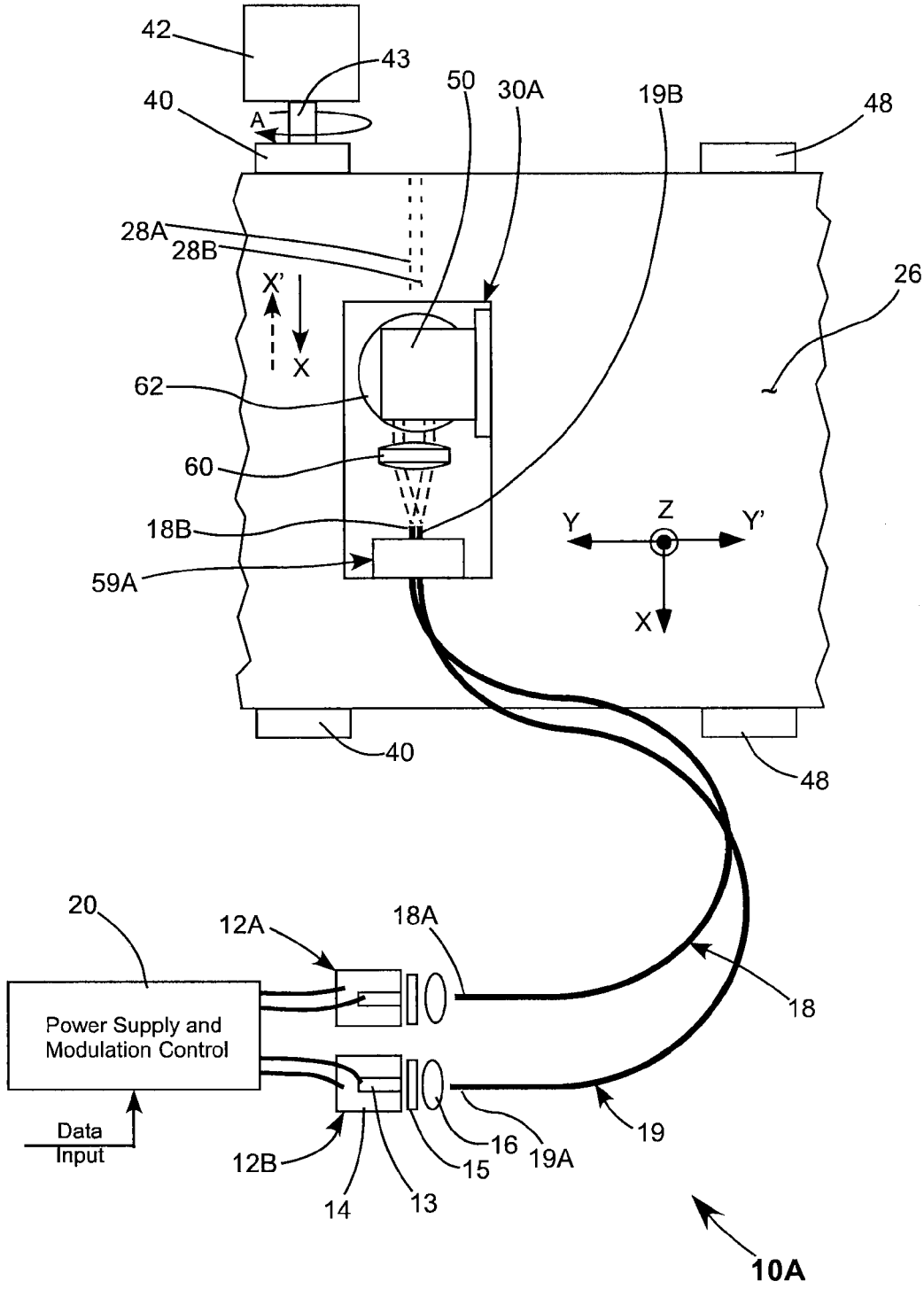
FIG. 1C is a plan view from above schematically illustrating an alternate arrangement of the apparatus of FIG. 1A wherein the carriage is re-oriented and the alignment block is reconfigured to provide a different alignment of fibers consistent with the re-orientation.

FIG. 1C is a plan view from above schematically illustrating an alternate arrangement 10 of the apparatus of FIG. 1A. Carriage 30A replaces carriage 30 of apparatus 10. The carriage is re-oriented with the length thereof in the X-direction. Consistent with this re-orientation, alignment block 59 of carriage 30 is replaced with alignment block 59A in carriage 30A. Here, the fibers are held in the alignment block spaced apart in the Y-direction. This arrangement may provide for less stress on fibers 18 and 19, during motion of the carriage, than in apparatus 10.

Figure 2A:
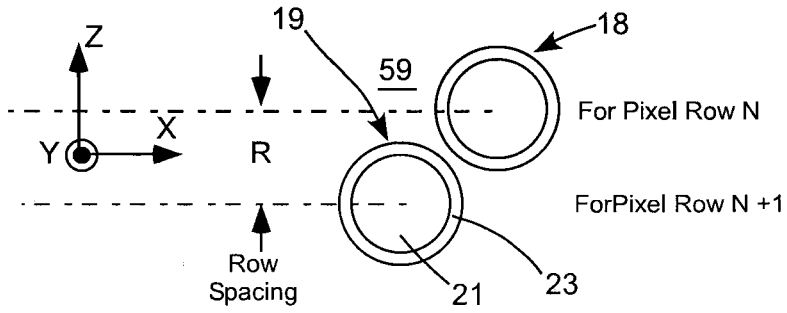
FIG. 2A schematically illustrates one arrangement of distal ends of the fibers in the alignment block of FIG. 1A for providing two adjacent rows of image pixels on the tape.
Figure 2B:
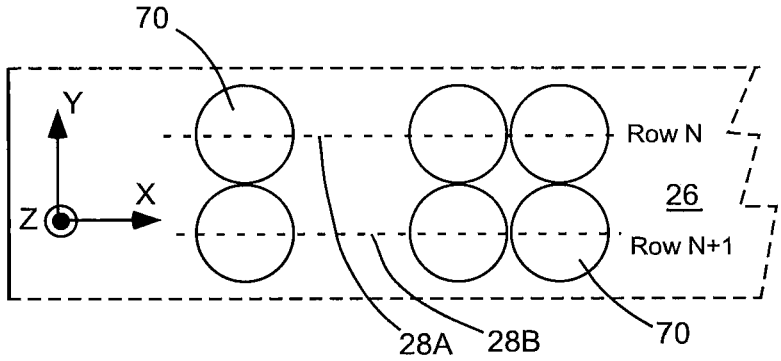
FIG. 2B schematically illustrates a portion of two adjacent rows of image pixels drawn on the tape using the fiber arrangement of FIG. 2A.
Figure 2C:
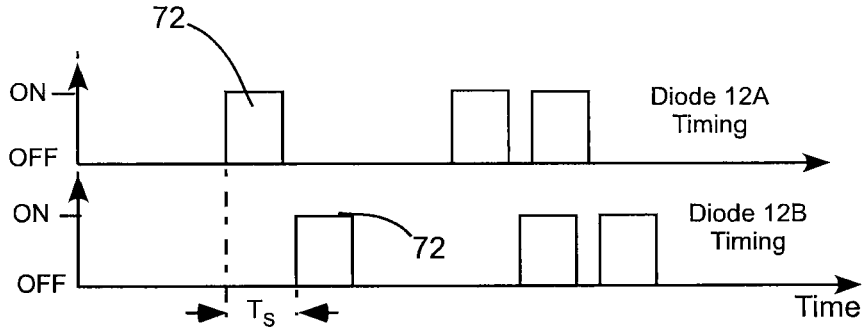
FIG. 2C is a timing diagram schematically illustrating laser pulse timing required to provide the pixels of FIG. 2B with the fiber alignment of FIG. 2B.

FIG. 2A, FIG. 2B, and FIG. 2C schematically illustrate detail of one preferred alignment of fibers 18 and 19 in fiber-alignment head 59 of apparatus 10, and corresponding pixel row arrangement and diode-laser modulation-timing. Referring first to FIG. 2A, each fiber has a core 21 surrounded by a cladding 23. In one preferred configuration for fibers 18 and 19, core 21 is a multimode core having a diameter of about 105.0 micrometers (μm). Cladding 23 has a thickness of about 10.0 resulting in an overall diameter of the optical fibers of about 125.0 μm. The fibers are spaced apart in the Z direction by a distance R. In this example, R is selected to be equal to about the core diameter of the optical fibers such that images 70 of the cores, focused onto tape 26, and forming individual pixels, will be contiguous in the Y-direction (the axis change here resulting from the folded optical arrangement) as depicted in FIG. 2B. For a 1:1 (unit magnification) imaging arrangement R will be equal to the row spacing of images (picture elements or pixels). The fibers are also spaced apart in the X-direction (translation-direction) to allow for the core thickness.

In the pixel arrangement of FIG. 2B, portions of rows 28A and 28B are depicted with three identical pixels in each aligned in the Y-direction. The pixels are drawn during an "on" period of the beam from corresponding diode-laser. In order to achieve this alignment, diode-lasers 12A and 12B must be modulated with a phase (timing) difference $T_S$ (see FIG. 2C) that corrects for the X-axis spacing of the fibers in alignment head 59. Here, it should be noted that the diode-laser itself does not necessarily need to be "off" when a pixel is not being drawn but merely emitting at a level sufficiently low that the tape will not be marked by the focused radiation.

Figure 3A:
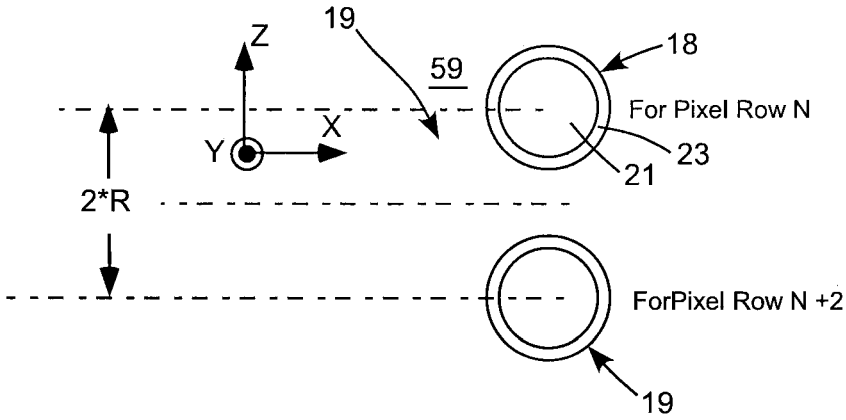
FIG. 3A schematically illustrates another arrangement of distal ends of the fibers in the alignment block of FIG. 1A for providing rows of image pixels on the tape spaced apart by one row-width.
Figure 3B:
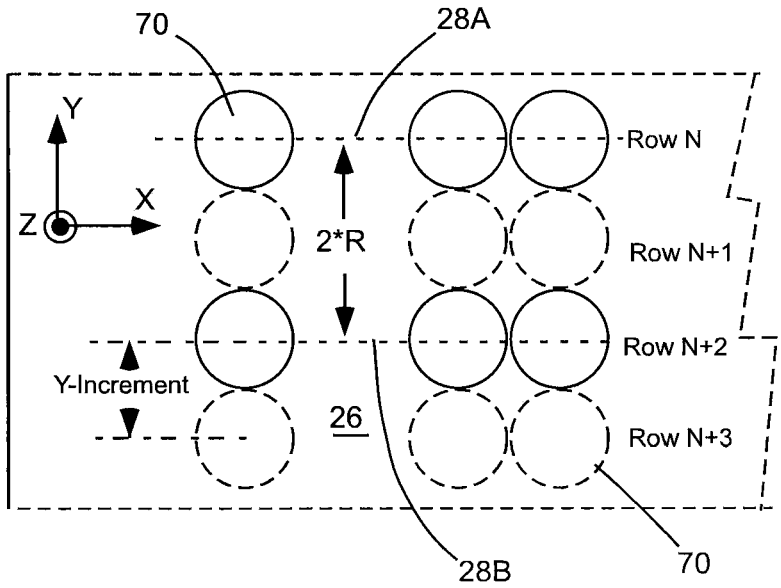
FIG. 3B schematically illustrates a portion of four adjacent rows of image pixels drawn on the tape using the fiber arrangement of FIG. 2A by drawing two overlapping pairs of pixel rows.

FIG. 3A and FIG. 3B schematically illustrate another arrangement of the distal ends of fibers in alignment block 59 of FIG. 1A for providing rows of image pixels on the tape spaced apart by one row-width. FIG. 3B schematically illustrates a corresponding arrangement of pixels in rows 28A and 28B on tape 26. In the fiber arrangement of FIG. 3A, fibers 18 and 19 are aligned in the Z-direction and spaced apart by two-core diameters, which in a 1:1 imaging arrangement corresponds to two row-spacings R on tape 26 (see FIG. 3B).

Continuing with reference in particular to FIG. 3B, in a corresponding printing algorithm: rows N and N+2 (shown in solid lines) are printed in one translation of carriage 30 across tape 26; the tape motion is incremented by one row spacing; and rows N+1 and N+3 (shown in dashed-lines) are printed with row N+1 exactly between rows N and N+2. This fiber and row-printing arrangement has an advantage that diode-lasers 12A and 12B can be modulated in-phase.

Clearly, in either arrangement, three or more diode-lasers, individually addressed and modulated, could be provided to print three or more pixel-rows per translation of the carriage. In an arrangement similar to that of FIGS. 2A-C, with contiguous rows, the tape would need to be advanced after each translation by the number of rows equal to the number of lasers. In an arrangement similar to that of FIGS. 3A-B, the tape is alternately incremented by only one row-spacing followed by a jump equal to the number of lasers.

In either arrangement, other laser types that can be readily modulated may be substituted for diode-lasers 12A and 12B, without departing from the spirit and scope of the present invention. It is even possible to use, as transport fibers 18 and 19, an active fiber with a doped core, and appropriate resonator-defining fiber Bragg gratings, such that the transport fibers are in fact fiber-lasers. In this case, the lasers could be optically pumped by diode-lasers 12A and 12B, with the diode-lasers modulated to provide corresponding modulation of the fiber-laser output.

It should be noted here that in the description provided above is made with reference to 1:1 imaging optics for projecting images of laser-illuminated distal ends of the optical fibers on the tape. Those skilled in the art will recognize that other imaging optics, with a different magnification ratio, may be used without departing from the spirit and scope of the present invention. By way of example, 2:1 down-imaging optics may be used to provide an image (pixel) size on the tape smaller than that of the core. It is even possible to use anamorphic imaging optics to create a pixel shape that has different dimensions in the X- and Y-directions. A spot having a smaller dimension in the X-direction than in the Y-direction could be used to create higher beam intensity on the tape, without reducing the area of the tape printed in one translation of the carriage.

It should also be noted that while image elements or pixels are depicted in FIG. 2B and FIG. 3B as being about the same dimensions, modulation of the lasers can be effected such that a laser stays "on" to provide an effect similar to that represented by a contiguous row of pixels. In such an arrangement image elements in any row of a printed image may have different dimensions. It was found, however, that continuous exposure needed to create a large image element could lead to blistering or de-lamination of certain multi-layer laser sensitive tapes. Using "same-size" image elements appeared to leave sufficient unprinted (not ablated) tape between pixels that the tape layers remained laminated.

Figure 4:
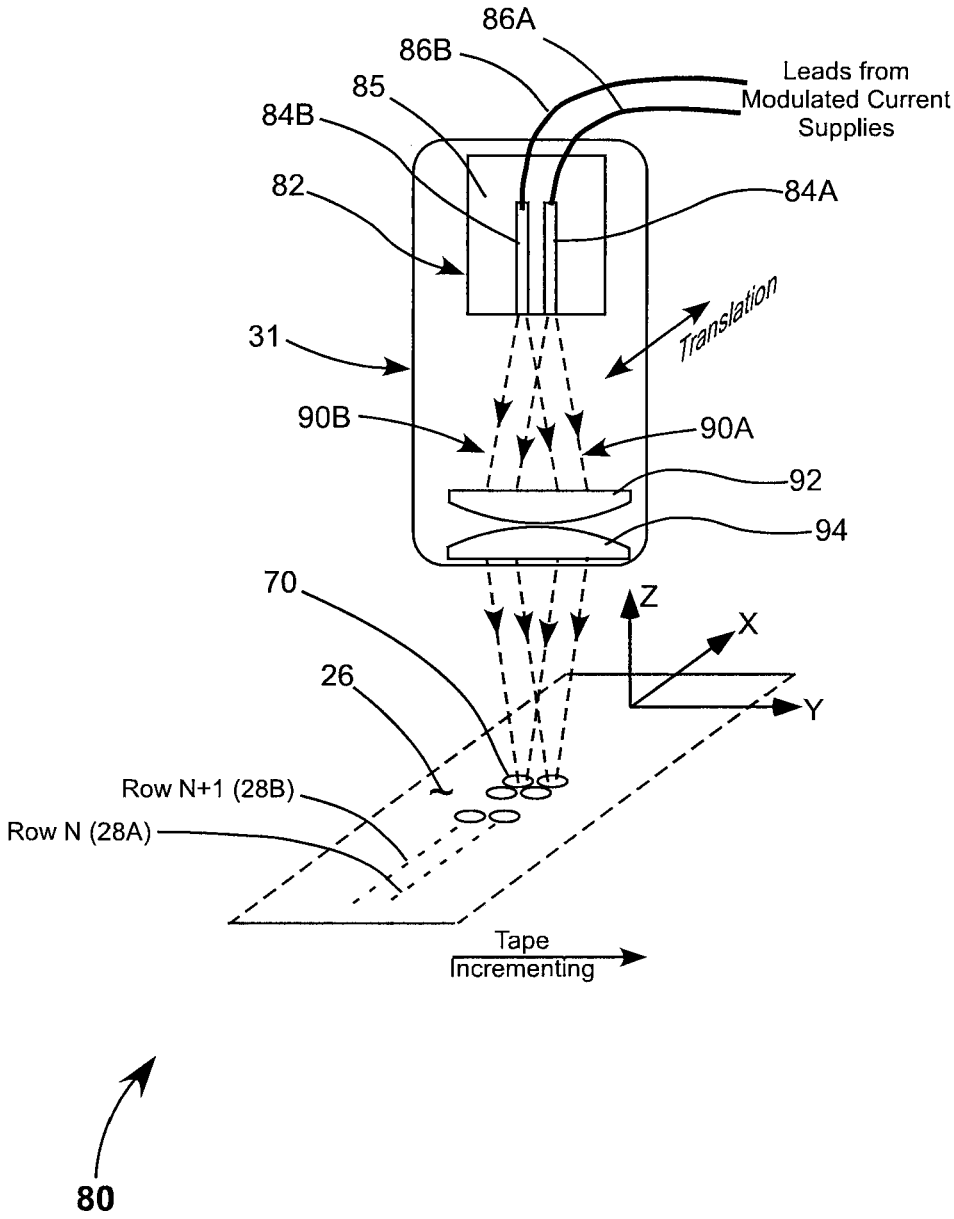
FIG. 4 schematically illustrates another preferred embodiment of laser marking apparatus in accordance with the present invention, similar to the apparatus of FIGS. 1A-B, but wherein modulated laser radiation is provided by a two-emitter diode-laser array mounted on the translatable carriage.

FIG. 4 schematically illustrates another preferred embodiment 80 of laser marking apparatus in accordance with the present invention, similar to the apparatus of FIGS. 1A-B, but wherein modulated laser radiation is provided by a two-emitter, diode-laser array 82 mounted on the translatable carriage, here, designated as carriage 31. Tape-drive arrangements for laser-radiation sensitive tape 26 are similar to those of FIGS. 1A-B, and are omitted here for simplicity of description.

Diode-laser array 82 includes emitters 84A and 84B grown on a substrate 85, and individually driven by corresponding modulated current-supplies (not shown). Current is delivered from the supplies by leads 86A and 86B, respectively. The arrangement of multiple emitters on a substrate in this manner is commonly referred to by practitioners of the semiconductor laser art as a diode-laser bar.

Carriage 31 is arranged with diode-laser array 82 mounted thereon such that emitters 84A and 84B emit beams of radiation 90A and 90B, respectively, generally in the Z-direction. The (modulated) beams are focused by lenses 92 and 94 onto tape 26 to form pixel rows 28A and 28B by translating carriage 30A in the X-direction as described above with reference to FIGS. 1A and 1B.

One advantage of apparatus 80 is that there can be considerable flexibility in selection of the emitter width and corresponding size of pixels 70 in the tape. A closer emitter spacing is possible than the fiber spacing described above with reference to apparatus 10. This, in theory at least, affords flexibility in selecting image resolution. Further, adding additional radiation sources to print more rows per translation of the carriage, is merely a matter of adding additional emitters to array (diode-laser bar) 82. Any of the printer algorithms described above can be used with apparatus 90.

Another advantage of direct imaging (focusing) of the diode-laser outputs in is that the resulting focal spot (image) area on tape can be much smaller than in the case of apparatus 10. By way of example, with 1:1 imaging optics, a directly-focused spot can have dimensions of about 20.0 μm by about 100.0 μm, compared with a circular area about 100.0 μm in diameter. This provides for higher intensity on tape and longer depth of focus. Those are important parameters for contrast, throughput and consistency of print.

The present invention is described above with reference to a preferred and other embodiments. The invention is not restricted, however, to the embodiments described and depicted herein. Rather the invention is limited only by the claims appended hereto.

What is claimed is:

1. Apparatus for drawing an image on laser-radiation-sensitive tape, the image including a plurality of rows of image-elements, the apparatus comprising:

a tape-drive arranged to drive the tape incrementally in a first direction;

a carriage translatable over the tape in a second direction transverse to the first direction;

a plurality of lasers remote from the carriage, each thereof arranged to deliver a beam of laser-radiation modulated in accordance with a row of image-elements of the image to be drawn, and a corresponding plurality of optical fibers arranged to transport the modulated laser-radiation beams to the carriage with modulated laser beams being delivered from distal ends of the optical fibers which are in a predetermined alignment on the carriage and spaced apart by a first predetermined distance;

an optical arrangement mounted on the carriage for focusing the laser-radiation beams delivered from the distal ends of the optical fibers on the tape, with the optical arrangement cooperative with the alignment of the distal ends of the optical fibers such that each focused, modulated laser-radiation beam draws an image-element during an "on" period thereof, the beam-foci being spaced apart in the second direction by a second predetermined distance corresponding to the first predetermined distance, and wherein said optical arrangement includes a first common lens for collimating the light emitted from the distal ends of each of the optical fibers and a second common lens for focusing the collimated light onto the tape; and whereby, when the carriage is translated over the tape with the modulated laser-beams focused thereon, a plurality of second-direction spaced-apart rows of the image-elements are drawn with each translation of the carriage over the tape, the plurality of rows corresponding to the plurality of laser-beam sources.

2. The apparatus of claim 1, wherein the optical arrangement for focusing the laser radiation beams delivered from the distal ends of the fibers is a 1:1 imaging arrangement and the first and second predetermined spacing distances are about equal.

3. The apparatus of claim 1, wherein the modulation of the laser-beams is arranged such that the image elements have about the same dimensions.

4. The apparatus of claim 1, wherein the lasers in the plurality thereof are diode lasers.

5. The apparatus of claim 1, wherein the distal ends of the optical fibers are aligned on the carriage in the first direction.

6. The apparatus of claim 1, wherein there are two lasers and two optical fibers in the plurality thereof, and the rows of elements in the image thereof have a row-spacing in the first direction, and wherein the spacing of the distal ends of the optical fibers on the carriage is selected such that element-rows N and N+1 of the image are drawn with each translation of the carriage over the tape.

7. The apparatus of claim 1, wherein there are two lasers and two optical fibers in the plurality thereof, and the rows of elements in the image thereof have a row-spacing in the first direction, and wherein the spacing of the distal ends of the optical fibers on the carriage is selected such that element-rows N and N+2 of the image are drawn with each translation of the carriage over the tape.

8. The apparatus of claim 7, wherein the incremental driving of the tape is arranged such that after element-rows N and (N+2) of the image are drawn with one translation of the carriage over the tape, the tape is incrementally moved in the first direction by one row-spacing and element-rows N+1 and N+3 of the image are drawn in a subsequent translation of the carriage over the tape.

9. An apparatus for marking a laser responsive strip comprising:

a drive system for incrementally translating the strip in a first (Y) direction;

at least two lasers mounted at a location spaced from the strip;

a modulated power supply for controlling the output of the lasers;

a carriage carrying optics for directing and focusing laser light onto the strip in the form of spots; and a plurality of optical fibers, each fiber associated with one of the lasers, with the distal ends of each fiber being positioned to receive the output of the one of the lasers and with the distal ends thereof terminating at the carriage, said carriage being translatable in a second direction (X) perpendicular to the first direction whereby in operation, the carriage is translated in the second direction for marking rows on the strip corresponding to the numbers of lasers and wherein the strip is then translated to permit the next set of rows to be marked and wherein the optics on the carriage includes a first common lens for collimating the light emitted from the distal ends of each of the optical fibers and a second common lens for focusing the collimated light onto the strip.

10. An apparatus as recited in claim 9 wherein the carriage includes a block for supporting the distal ends of the fibers and wherein said fibers are mounted in a spaced apart manner in a direction (Z) perpendicular to the first and second directions and wherein the optics on the carriage causes the laser light emitting from the proximal ends of the fibers to be spread in the first (Y) direction.

11. An apparatus as recited in claim 10 wherein the spacing between the centers of the spots on the strip in the first (Y) direction is about the diameter of the spots.

12. An apparatus as recite in claim 9 wherein the carriage includes a block for supporting the distal ends of the fibers and wherein said fibers are mounted in a spaced apart direction in the first (Y) direction.

13. An apparatus as recited in claim 12 wherein the optics on the carriage causes the laser light emitting from the distal ends of the fibers to be spaced apart in the first (Y) direction in an amount so that the spacing between the centers of the spots on the strip in the first (Y) direction is about equal to 2N beam diameters, wherein N is equal to the number of lasers.

* * * * *